United States Patent [19]

Tringali

[11] Patent Number: 4,677,269

[45] Date of Patent: Jun. 30, 1987

[54] ISOLATION SWITCH HAVING A LOCKING BAIL ARM

[75] Inventor: Dominick Tringali, Columbia, S.C.

[73] Assignee: Square D Company, Palatine, Ill.

[21] Appl. No.: 754,871

[22] Filed: Jul. 12, 1985

[51] Int. Cl.[4] ..... H01H 3/00

[52] U.S. Cl. ..... 200/324; 200/325; 74/100 R

[58] Field of Search ..... 200/147 R, 324, 325, 200/153 G

[56] References Cited

U.S. PATENT DOCUMENTS

| | | | |
|---|---|---|---|
| 1,624,372 | 4/1927 | Stoeltzlen | 200/325 |
| 2,754,389 | 7/1956 | Yarrick | 200/89 |
| 3,205,333 | 9/1965 | Bonnefois et al. | 200/325 |
| 3,457,531 | 7/1969 | Goodwin, Jr. | 335/168 |
| 3,496,319 | 2/1970 | Norden | 200/146 |
| 3,544,931 | 12/1970 | Patel | 335/174 |
| 3,611,215 | 10/1971 | Patel | 335/20 |
| 3,749,862 | 7/1973 | Wilson et al. | 200/50 AA |
| 3,750,059 | 7/1973 | Patel et al. | 335/142 |
| 3,760,307 | 9/1973 | Patel | 335/13 |
| 3,770,917 | 11/1973 | Tjebben | 200/50 AA |
| 3,801,765 | 4/1974 | Hodgson | 200/153 G |
| 3,896,353 | 7/1975 | Burton et al. | 317/103 |
| 4,086,452 | 4/1978 | Collins | 200/50 AA |

*Primary Examiner*—Clifford C. Shaw
*Assistant Examiner*—Lincoln Donovan
*Attorney, Agent, or Firm*—A. Sidney Johnston; Richard T. Guttman

[57] ABSTRACT

An isolation switch has at least one first cam attached to a blade of the isolation switch, the first cam arranged to rotate about a first axis. At least one second cam is arranged to rotate about a second axis. The first and second cams engage so that rotation of the second cam in a first rotational sense urges rotation of the first cam so as to engage the blade with a fixed contact, thereby closing the isolation switch. The first cam, when under the influence of electromagnetic forces resulting from current flow through the isolation switch tending to open the isolation switch, urges rotation of the second cam in the first rotational sense. The second cam is prevented from rotation in the first rotational sense beyond the predetermined angular position, where the predetermined angular position is chosen to permit the second cam to close the isolation switch, and prevention of rotation of the second cam locks the isolation switch closed, thereby preventing forces developed on the isolation switch under short circuit conditions from opening the isolation switch.

18 Claims, 27 Drawing Figures

ISOLATION SWITCH HAVING A LOCKING BAIL ARM

FIELD OF THE INVENTION

This invention relates to isolation switches for use in an enclosure containing other electrical components for isolating those components from an electrical service line, and particularly to an isolation switch which prevents electromagnetic forces generated during short circuit conditions from blowing open the isolation switch.

BACKGROUND OF THE INVENTION

In an enclosure containing electrical apparatus, it is often desirable to have the incoming electric service lines first connect to an isolation switch, and then other electrical apparatus to attach to the downstream side of the isolation switch. Often fuses, circuit breakers or other overload interrupt devices are attached downstream from the isolation switch.

It is desirable to have an overload blow a fuse or trip a circuit breaker rather than blow open the isolation switch. Fuses and circuit breakers are designed to interrupt the heavy currents to be expected during short circuit conditions. An isolation switch is not designed to interrupt such heavy current flows. However, electromagnetic forces generated during high current conditions experienced during a short circuit may generate forces on the conductors of the isolation switch and the isolation switchblades. The forces may be of such a nature as to drive the switchblades "open". Thus, under heavy current flow short circuit current conditions, the isolation switch may be blown open by the current flowing through the switchblades. The purpose of the isolation switch may thereby be defeated by the electromagnetic forces generated during short circuit conditions, and the fuse or other interrupt device may not have an opportunity to interrupt the circuit because the isolation switch is blown open.

A continuing problem in the design of isolation switches has been to develop a system which will withstand the electromagnetic forces generated during severe short circuit conditions.

SUMMARY OF THE INVENTION

An isolation switch in which the blades are locked against being blown open by a heavy current flow experienced during a short circuit condition is provided by the invention. An isolation switch has at least one first cam attached to a blade of the isolation switch, the first cam arranged to rotate about a first axis. At least one second cam is arranged to rotate about a second axis. The first and second cams engage so that rotation of the second cam in a first rotational sense urges rotation of the first cam so as to engage the blade with a fixed contact, thereby closing the isolation switch. The first cam, when under the influence of electromagnetic forces resulting from current flow through the isolation switch tending to open the isolation switch, urges rotation of the second cam in the first rotational sense. The second cam is prevented from rotation in the first rotational sense beyond the predetermined angular position, where the predetermined angular position is chosen to permit the second cam to close the isolation switch, and prevention of rotation of the second cam locks the isolation switch closed, thereby preventing forces developed on the isolation switch under short circuit conditions from opening the isolation switch.

Other and further aspects of the present invention will become apparent in the course of the following description and by reference to the accompanying drawings.

BRIEF DESCRIPTION OF THE DRAWINGS

Referring now to the drawings in which like numerals represent like parts in the several views.

DETAILED DESCRIPTION

Figure 1:
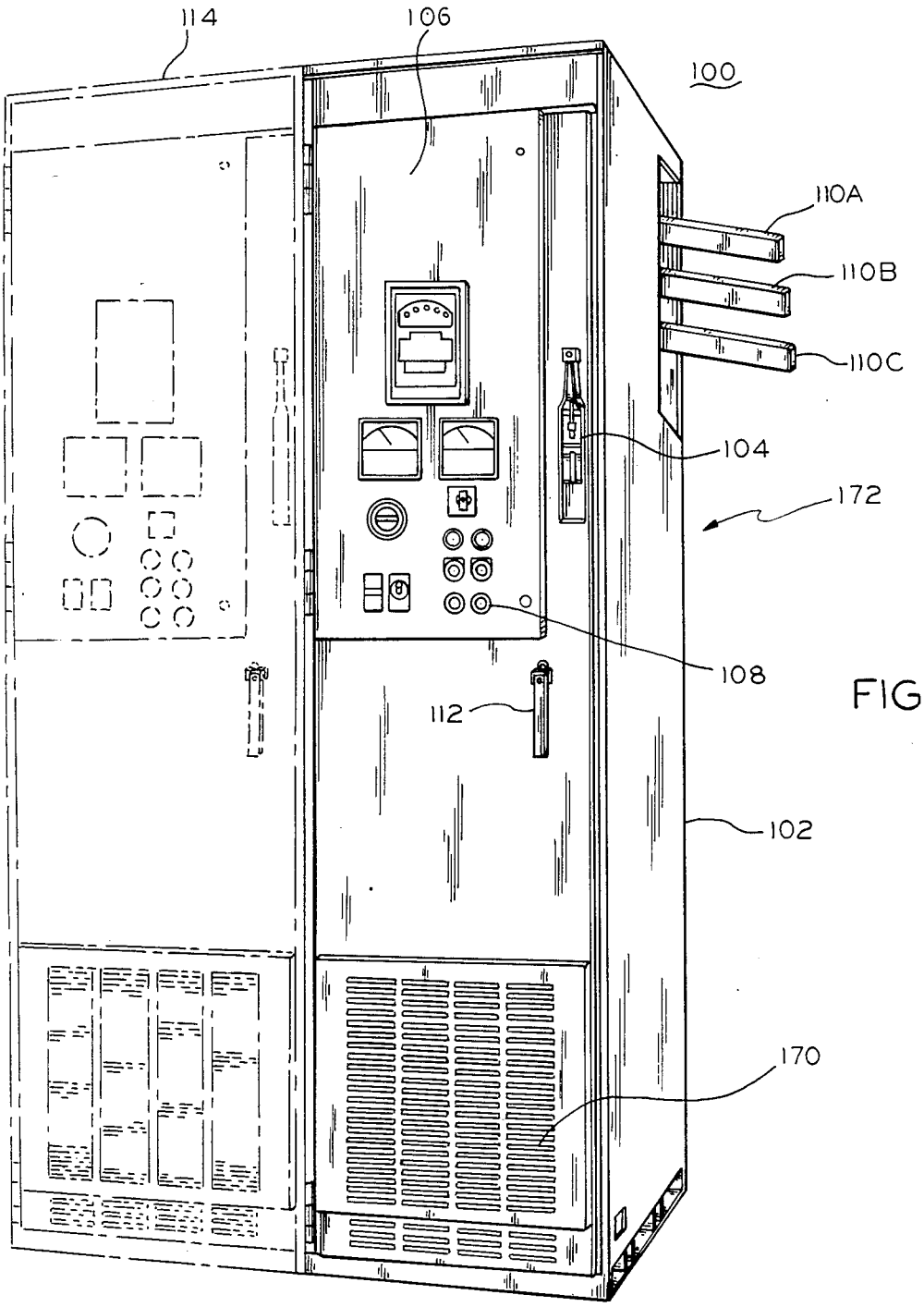
FIG. 1 shows a medium voltage controller, and a second controller in dotted lines ganged to the first controller.

A controller 100 for medium voltage applications is shown in FIG. 1. For example, the controller may be used as a motor controller for controlling the current flow to an electric motor. The controller as shown in FIG. 1 is, for example, suitable for controlling current flow to a three phase electric motor where the voltages involved are in the kilovolts range, and the currents involved are in the 300 ampere to 400 ampere range.

Operating handle 104 is used to operate an isolation switch (not shown in FIG. 1). Meters 106 are used to indicate electrical quantities such as, for example, voltage applied to a load, current flow into a load, power flow into a load, reactive power flow into a load, and other electrical quantities for which an indication is desired. Operating buttons 108 may be used, for example, to activate an electromagnetic contactor to make and break the circuit to a load. Conductors 110*a*, 110*b*, and 110*c*, for example, are three phase bus bars for bringing electrical current into controller 100.

An optional ganged controller is shown in dotted lines. A number of controllers may be ganged together as shown by ganged controller 114, and power conveniently delivered to each by conductors 110*a*, 110*b*, 110*c* passing through the various ganged controllers.

Figure 2:
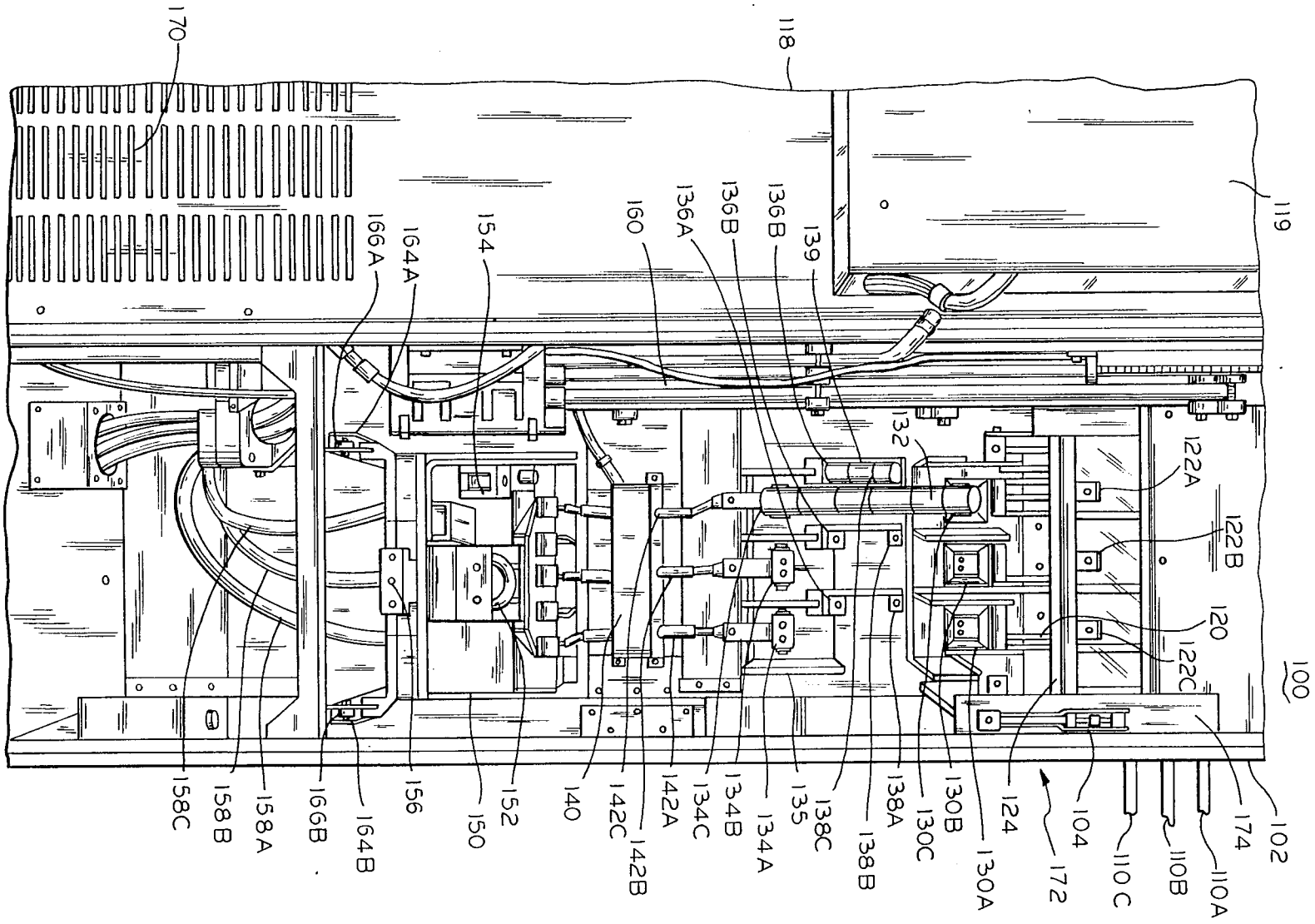
FIG. 2 shows the interior of a medium voltage controller as seen with the door open.

FIG. 2 shows the interior of controller 100 with door 118 standing open. Enclosed instrument panel 119 is mounted upon door 118. Enclosed instrument panel 119 protects the wiring and the meters for instruments 106 from exposure to the high voltage conductors within enclosure 100. Bus bars 110*a*, 110*b* and 110*c* deliver electric current to controller 100. Isolation switch 120 connects to the bus bars through connectors 122*a*, to bus bar 110*a*, connector 122*b* to bus bar 110*b*, and connector 122*c* to bus bar 110*c*. Operating handle 104 is used to open or close isolation switch 120. The load side of isolation switch 120 connects to upper power fuse clips 130*a*, 130*b* and 130*c*. Fuse 132 is shown installed in fuse clip 130*c*. The load side of fuse 132 connects to lower power fuse clips 134*c*. Also, lower power fuse clips 134*a* and 134*b* are shown. Lower power fuse clips 134*a*, 134*b*, 134*c* are mounted in molding 135. Also mounted in molding 135 are control circuit line side fuse clips 136*a*, 136*b* and 136*c*. Control circuit load side fuse clips 138*a*, 138*b* and 138*c* are also mounted in molding 135. A control circuit fuse 139 is shown installed between control circuit line side fuse clip 136*c* and control circuit load side fuse clip 138*c*. Conductors 142*a*, 142*b* and 142*c* connect lower power fuse clips 134*a*, 134*b* and 134*c* to the terminals of contactor 150. Contactor 150 as shown in FIG. 2 is a vacuum break contactor using vacuum break bottles. Alternatively, an air break contactor may be used for contactor 150. Conductors 142*a*, 142*b* and 142*c* pass through current transformer 140. For example, current transformer 140 may be three separate current transformer windings, one for each of the conductors 142*a*, 142*b*, 142*c*, and all three windings encapsulated in a single package.

Contactor 150, drawn as a contactor using vacuum break bottles, has operating coil 152 and contactor control components 154 mounted for easy access when door 118 of enclosure 102 is open, as shown in FIG. 2. Contactor spring adjustment 156 also is easily accessible through open door 118, and provides a means for relaxing forces on the contactor operating spring.

Rails 164*a* and 164*b* provide a convenient means for sliding contactor 150 into place in enclosure 102. Contactor 150 has wheels 166*a* and 166*b* in order to facilitate mounting and demounting of contactor 150 in enclosure 102.

Cabeling 160 provides a means for a customer to connect a load to the load side of contactor 152 through cables 158*a*, 158*b* and 158*c*.

Louvers 170 in door 118 provide a means for air to enter enclosure 102 in order to provide cooling circulating air.

A control transformer for providing electrical current to the control components of controller 100 may conveniently be connected to control circuit load side fuse clips 138*a*, 138*b*, 138*c*.

Figure 3:
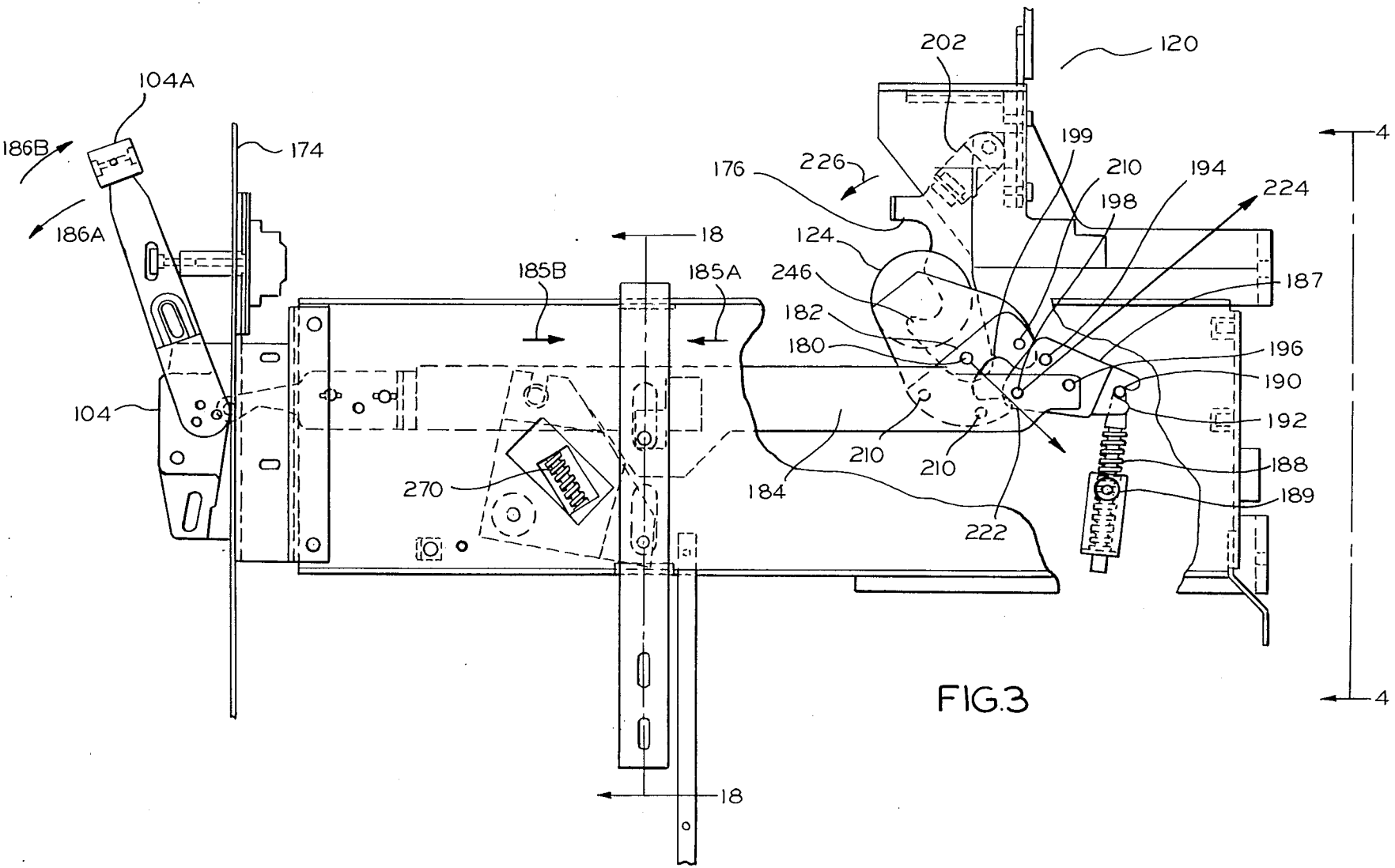
FIG. 3 is a detailed view of a isolation switch operating mechanism.

A partial operational diagram of an assembly for handle 104 to operate isolation switch 120 is shown in FIG. 3. FIG. 3 gives a view of the operating mechanism taken in the direction of arrow 172 as shown in FIG. 1 and FIG. 2. Handle 104 is shown attached to mounting plate 174. Blades 176 of isolation switch 120 are shown in the closed position in FIG. 3. Bail arm 124 rotates about axle 180. Cams 182, 182A are, for example, a metal plate attached to bail arm 124, and cam 182 provides a hardened surface for the operating mechanism to drive rotation of the bail arm 124. Link 184 is moved in the direction of arrow 185*a*, or in the direction of arrow 185*b*, by rotational motion of hand lever 104*a*. Motion of hand lever 104*a* of handle 104 in the direction shown by arrow 186*a* moves link 184 in the direction of arrow 185*a*. Motion of hand lever 104*a* in the direction shown by arrow 186*b* moves link 184 in the direction shown by arrow 185*b*. Motion of link 184 causes rotation of operating cam 187 about axle 194. Toggle spring 188 applies force to pin 190 thereby applying force to the inner surface of slot 192 in operating cam 187. In the position shown in FIG. 3, toggle spring 188 urges operating cam 187 to rotate about axle 194 in a counterclockwise sense, as viewed from FIG. 3, which rotational sense tends to urge pin 190 upwardly in FIG. 3. Link 184 is coupled to operation cam 187 by drive pin 196.

Rotation of hand lever 104a in the direction shown by arrow 186*b* tends to move link 184 in the direction shown by arrow 185*b* and to consequently urge rotation of operating cam 187 in the counterclockwise direction, as does toggle spring 188 in the view as shown in FIG. 3.

Motion of hand lever 104*a* in the direction shown by arrow 186*a* urges link 184 to move in the direction shown by arrow 185*a*, and consequently urges operating cam 187 to rotate in the clockwise direction, that is it tends to urge pin 190 to move downwardly as shown in FIG. 3 and compress toggle spring 188. Clockwise rotation of operating cam 187 moves cam pin 198 into contact with surface 199 of bail arm cam 182. Pressure by cam pin 198 against surface 199 of bail arm cam 182 urges rotation of bail arm 124 in a counterclockwise direction about axle 180, thereby urging blade 176 to disengage from stationary contact 202. Thus, motion of hand lever 104*a* in the direction shown by arrow 186*a* tends to open isolation switch 120.

Mounting screws 210 attach bail arm cam 182 to bail arm 124.

Bail arm cam 182 in cooperation with operating cam 187 tends to lock blade 176 in the closed position in the presence of forces tending to rotate blade 176 in the direction shown by arrow 126.

Figure 14:
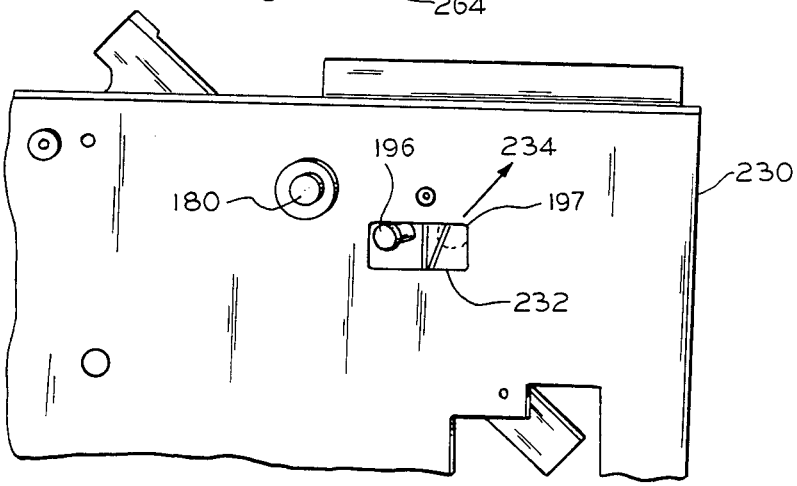
FIG. 14 is a perspective view of an isolation switch operating mechanism.

Rotation of blade 176 in the direction shown by arrow 226 by means of forces applied to blade 176 causes surface 222 of bail arm cam 182 to press against cam pin 198. Pressure by surface 222 against cam pin 198 produces force on cam pin 198 in the direction shown by arrow 224. Arrow 224 passes to the right of the center of axle 194 and therefore urges rotation of operating cam 187 in the counterclockwise direction. Operating cam 187 is prevented from further counterclockwise rotation than the position shown in FIG. 3 by the interaction of drive pin 196 with opening 232 in plate 230, as can better be understood by reference to FIG. 14. As shown in FIG. 14, plate 230 is fixedly attached to enclosure 102 of controller 100. Opening 232 in plate 230 accepts drive pin 196. Drive pin 196 is in position 197, as shown in dotted lines, when the operating mechanism is in the position as shown in FIG. 3. Further, counterclockwise rotation of operating cam 187 about axle 194 from the position shown in FIG. 3 causes drive pin 196 to exert force against plate 230 in the direction shown by arrow 234. Plate 230 does not move under the influence of forces in the direction shown by arrow 234 and thereby prevents further rotation of operating cam 187 in the counterclockwise direction from the position shown in FIG. 3. Therefore, forces applied to blade 176 cause surface 222 to urge against cam pin 198, and cam pin 198 causes drive pin 196 to urge in the direction shown by arrow 234 against plate 230, thereby effectively preventing motion of blade 176 in the direction shown by arrow 226. Thus, blade 176 is locked in the "on" position by cooperation between bail arm cam 182, cam pin 198, operating cam 187, drive pin 196, and plate 230.

It is advantageous to lock blade 176 in the "on" position as shown in FIG. 3 by the above mentioned cooperation of parts in order to prevent electromagnetic forces generated under short circuit conditions from blowing blades 176 of isolation switch 120 open.

Toggle spring 188 pivots about pin 189.

Figure 4:
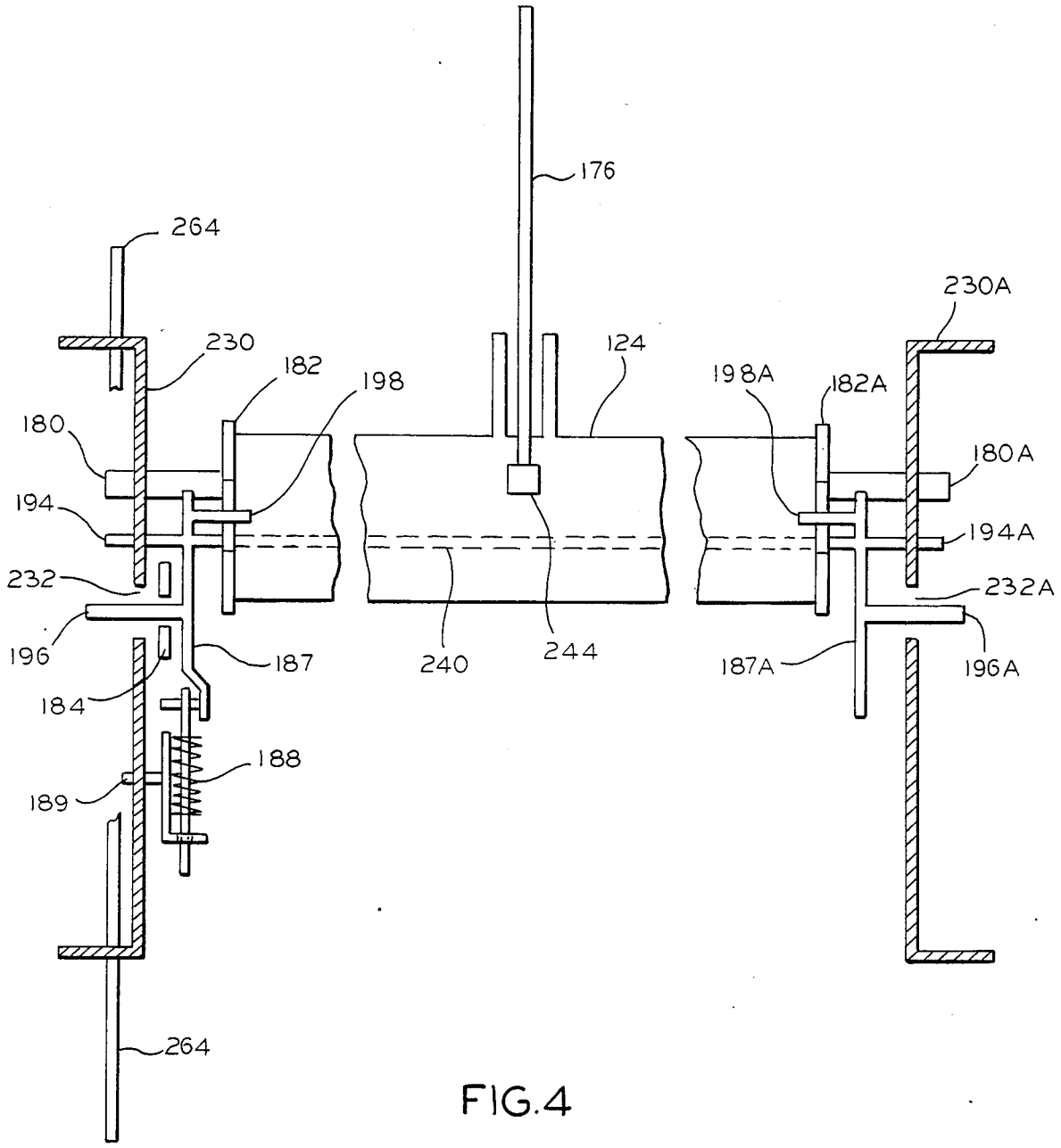
FIG. 4 is a sectional view of an isolation switch operating mechanism as seen in sectional arrows 4 in FIG. 3.
Figure 5:
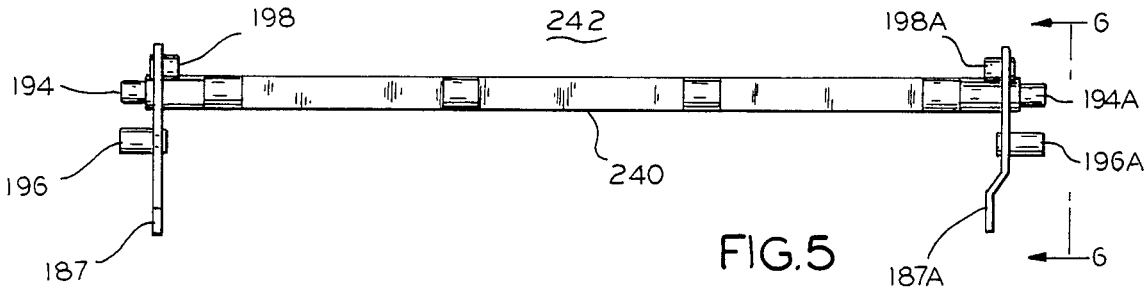
FIG. 5 is a top view of a cam and axle assembly.
Figure 6:
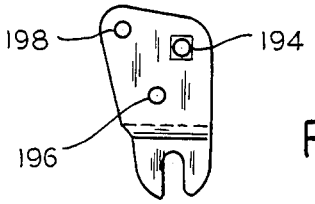
FIG. 6 is an end view of a cam and axle assembly.
Figure 7:
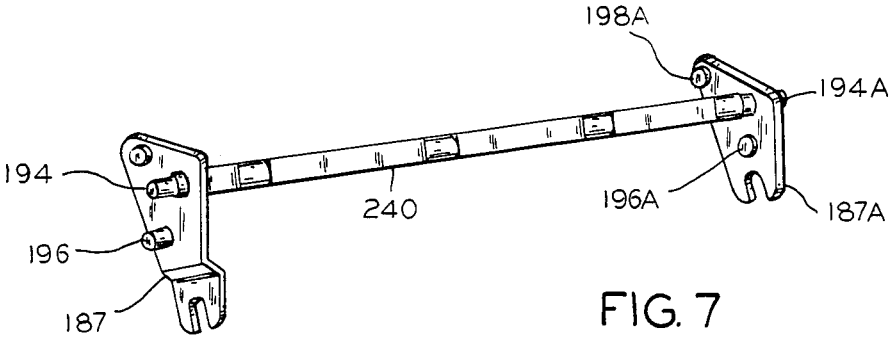
FIG. 7 is a perspective view of a cam and axle assembly.
Figure 9:
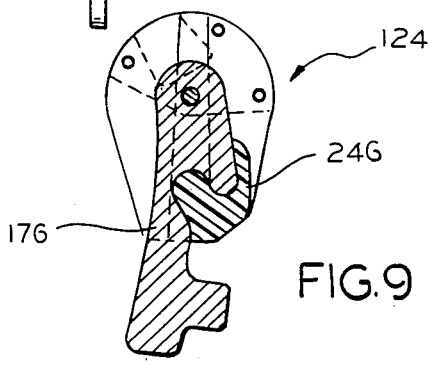
FIG. 9 is a cross sectional view of a bail arm.
Figure 16:
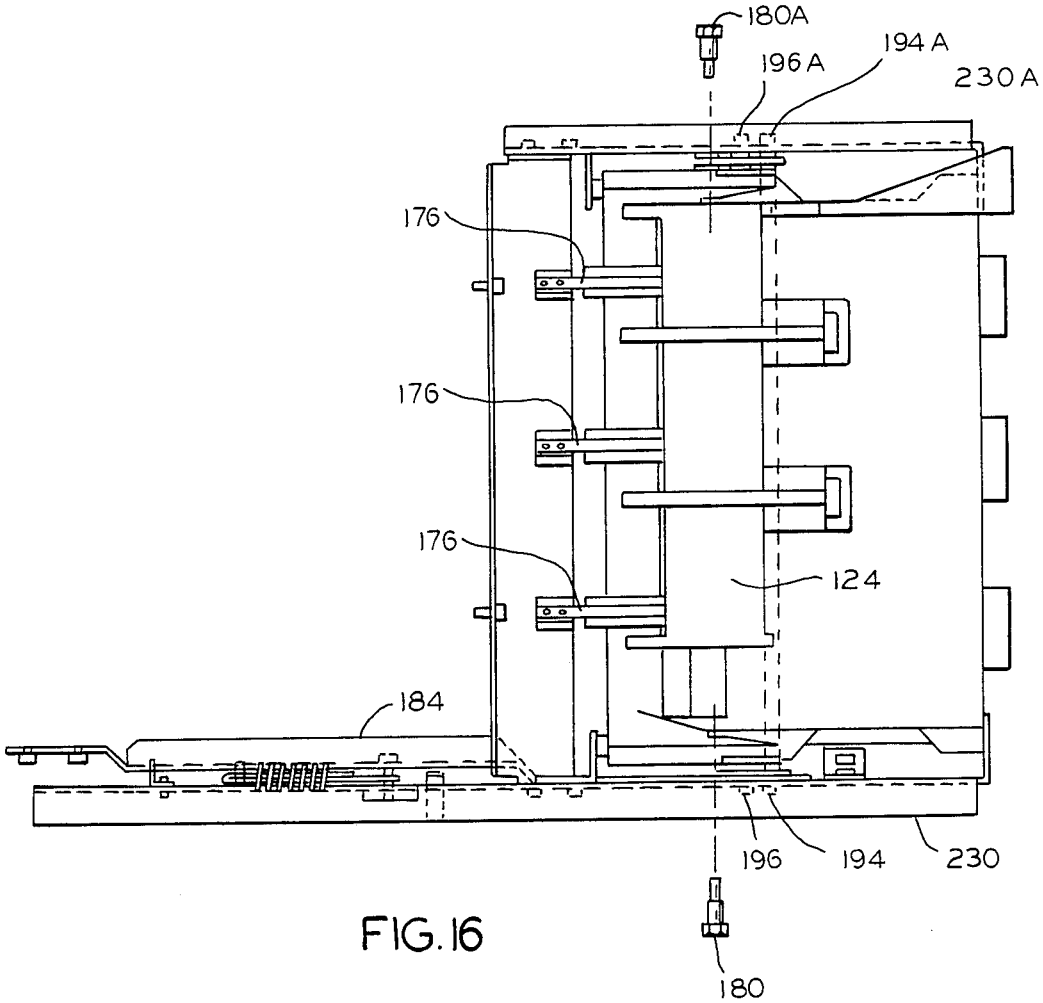
FIG. 16 is a top view of an isolation switch and operating mechanism.
Figure 17:
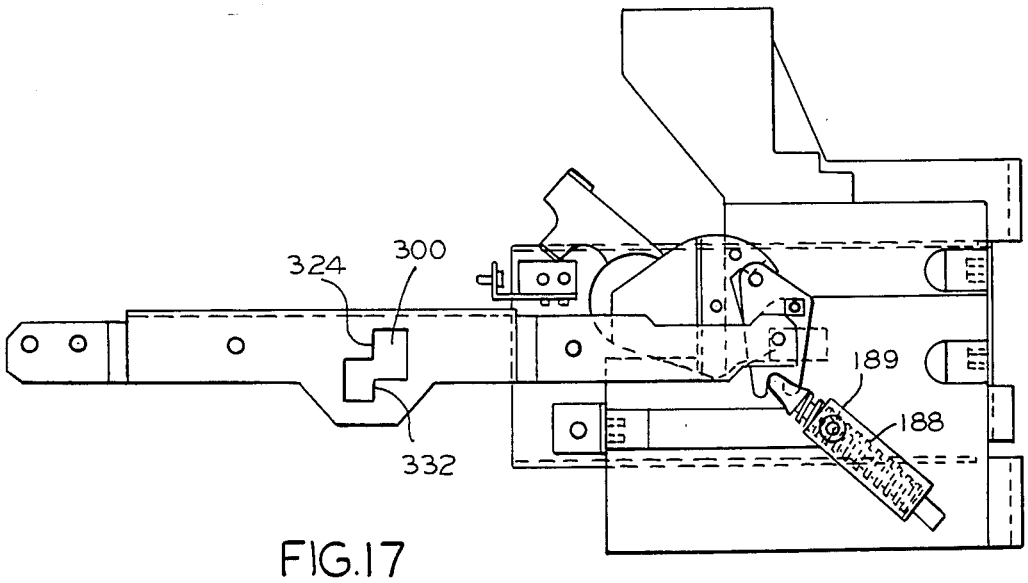
FIG. 17 is a side view of an isolation switch and operating mechanism.

FIG. 4 shows an end view of the bail arm and operating apparatus as shown by the arrows labeled 4 in FIG. 3. Bail arm 124 rotates about axle 180, and axle 180 rotates in a machined hole in plate 230. Bail arm 124 is shown as having axle 180 on the left and axle 180*a* on the right. Correspondingly, axle 180*a* rotates in a machined hole in plate 230*a*. Axles 180 and 180*a* are shown in top view in FIG. 16. Operating cam 187 and operating cam 187*a* are assembled on the axle 240 as is shown in greater detail in FIGS. 5, 6, and 7. The structure shown in FIGS. 5, 6 and 7 is referred to as assembled axle 242. Assembled axle 242 is made up of operating cam 187, operating cam 187*a*, and axle 240. Pins 194, 196, and 198 are assembled into operating cam 187. Pins 194*a*, 196*a*, and 198*a*, are assembled into operating cam 187*a*. Pins 194 and 194A are the turned ends of shaft 240. Referring to FIG. 4, axle 240 rotates about pins 194 and 194*a*, which fit into machined holes in plates 230 and 230*a* respectively. Link 184*a* urges rotation of operating cams 187 and 187*a* about axle 240. Motion of link 184 in the direction shown by arrow 185*b* in FIG. 3 urges link 184 to rise out of the plane of the drawing of FIG. 4, and further urges rotation of operating cams 187, 187*a* in the counterclockwise direction as shown in FIG. 3. Motion of link 184 in the direction shown by arrow 185*a* moves link 184 as shown in FIG. 4 below the plane of the drawing, and further urges clockwise rotation of operating cams 187, 187*a*. Pins 198, 198*a* engage bail arm cams 182, 182*a* respectively, and urge rotation of bail arm 124 bout axles 180, 180*a*. Rotation of bail arm 124 urges rotation of switch blade 176 about pivots 244, which are in line with pivots 180, 180A as shown in FIG. 16. In FIG. 4, bail arm 124 is shown in breakaway in two points. In FIG. 16, in top view, there are shown three switch blades 176 as operated by bail arm 124 as shown in FIG. 3 and FIG. 9. All of the switch blades 176 pivot about a line that is in alignment with axle 180 and axle 180*a* as shown in FIG. 4. Switch blade 176 has surface 246 which interlocks with a cross section of bail arm 124. Surface 246 captures switch blade 176 to bail arm 124 so that counterclockwise rotation of bail arm 124 about axles 180, 180*a* applies force to switchblade 176 thereby urging it to move in the direction shown by arrow 226.

Opening 232, as shown in FIG. 14 in plate 230, limits the angle of rotation that axle 240 can undergo. A corresponding opening 232*a* in plate 230*a* interacts with pin 196*a* to correspondingly limit the angle of rotation of axle 240. Electromagnetic forces generated during short circuit conditions and tending to blow switch blades 176 in the direction shown by arrow 226 in FIG. 3 are transmitted through operating cam 187, 187*a* to plates 230, 230*a* by pins 196 and 196*a*. Thus, pins 196, 196*a*, operating cams 187, 187*a*, surface 222 of bail arm cam 182, and a surface corresponding to surface 222 of bail arm cam 182*a* interacting with cam pins 198, 198*a* lock switch blade 176 in the closed position.

Figure 8:
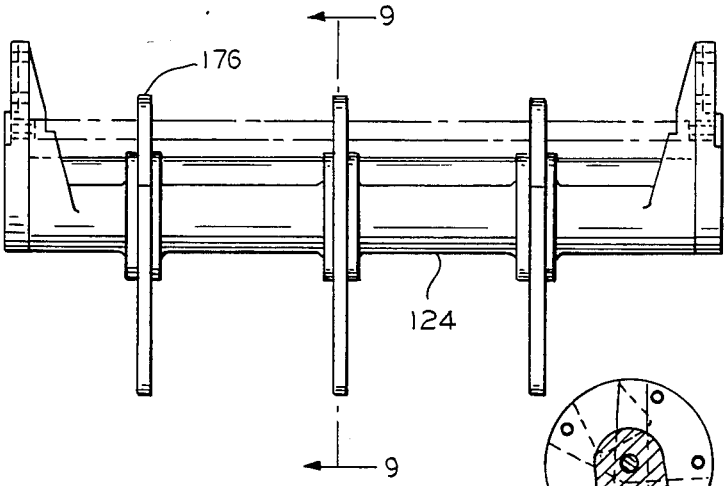
FIG. 8 is a top view of a bail arm.
Figure 10:
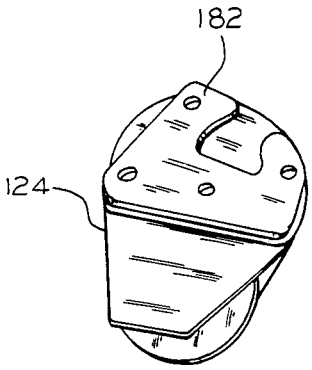
FIG. 10 is a detailed view of a bail arm and cam assembly.
Figure 11:
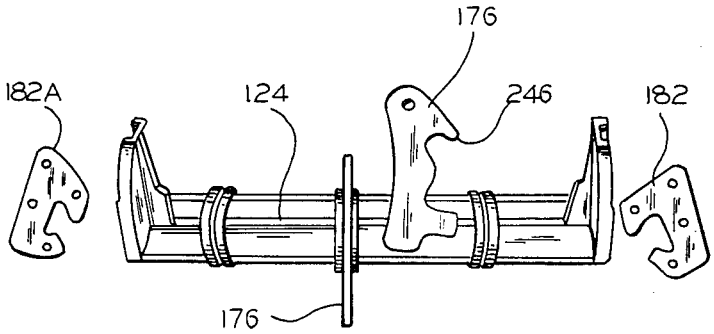
FIG. 11 is a detailed view of a bail arm, cam, and switch blade assembly.

FIG. 8 shows bail arm 124. FIG. 9 shows a cross section of bail arm 124. Surface 246 of switch blade 176 is shown in FIG. 9 in cooperation with the molded cross section of bail arm 124. For example, bail arm 124 may be made of glass reinforced polyester and produced in a plastic molding process. Switch blade 176 may be, for example, made out of sheet copper. FIG. 10 and FIG. 11 show more details of bail arm 124, cam 182 and cam 182*a* of bail arm 124, switch blade 176, and the assembly of the cams 182, 182*a* and switch blade 176 onto bail arm 124.

Figure 12:
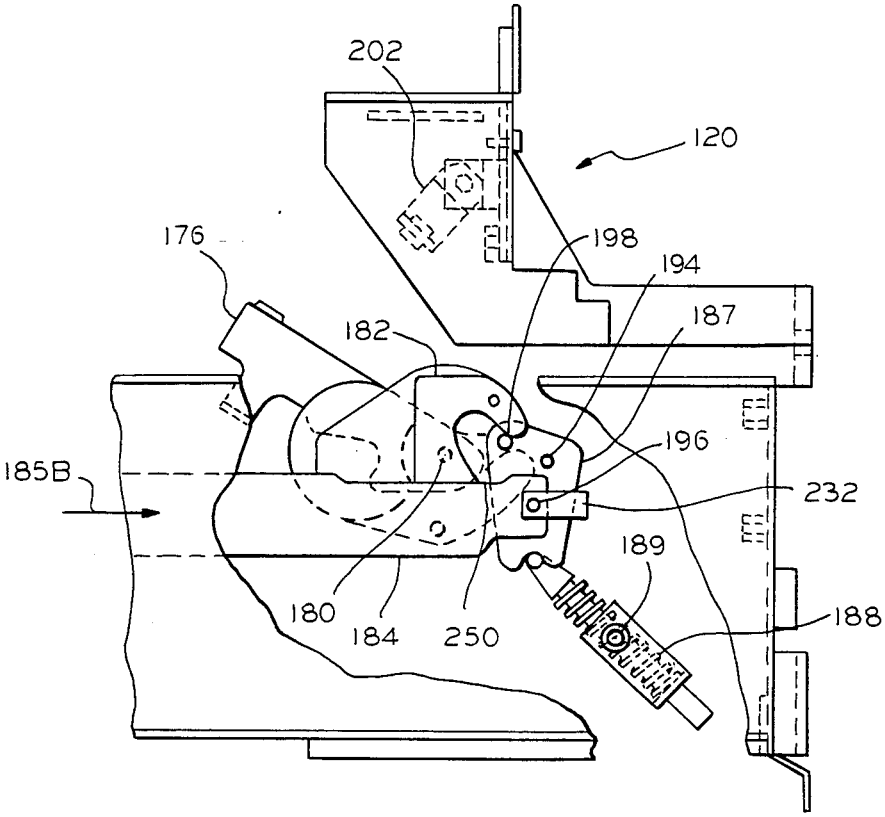
FIG. 12 is a detailed breakaway side view of an isolation switch operating mechanism.

FIG. 12 shows isolation switch 120 in the open position. Switch blades 176 are disconnected from stationary contact 202. Isolation switch 120 is operated into the closed position, as shown in FIG. 3, by motion of link 184 in the direction shown by arrow 185*b*. Closure of switch 120 is accomplished in the following manner. Link 184 urges pin 196 in the direction shown by arrow 185*b*. The motion of pin 196 in direction 185*b* urges counterclockwise rotation of operating cam 187 about axle 194. Counterclockwise rotation of operating cam 187 brings pin 198 into contact with surface 222 of bail arm cam 182. Pin 198 then urges clockwise rotation of bail arm cam 182 about axle 180. Also, rotation of operating cam 187 in the counterclockwise direction compresses toggle spring 188. When toggle spring 188 reaches its maximum compression, then the force exerted by toggle spring 188 on operating cam 187 shifts so as to tend to urge counterclockwise rotation of operating cam 187, and therefore to cause operating cam 187 to rotate rapidly into the closed position as shown in FIG. 3.

Rotation of operating cam 187 about pin 194 is limited to an angular range of, for example, 83 degrees, by pin 196 cooperating with opening 232 as shown in FIG. 14. Opening 232 is shown in FIG. 12, even through plate 230 is removed in the breakaway part of the drawing. Operating cam 187 moves into the position as shown in FIG. 3 under the influence of toggle spring 188.

Toggle spring 188 therefore produces a rapid snap action closing of switch blades 176 into statioary contacts 202. This rapid closing minimizes electrical arcing when closure of isolation switch 120 connects electric current into a load. A minimal load supplying a control circuit transformer is always present and may burn the contacts if the switch is opened or closed too slowly.

Opening of isolation switch 120 from the position shown in FIG. 3 to the position shown in FIG. 12 is accomplished by moving link 184 in the direction indicated by arrow 185*a*. Motion of link 184 urges clockwise rotation of operating cam 187 about pin 194 thereby bringing cam pin 198 into contact with surface 222 of bail arm cam 182 and thereby urging rotation of bail arm 124 in the counterclockwise direction about pin 180. After toggle spring 188 reaches its maximum compression, it snaps into the position shown in FIG. 12 thereby rapidly driving switch blade 176 out of contact with stationary contact 202. This rapid toggle action of toggle spring 188 minimizes the time that electric arc buildup can occur between switchblade 176 and stationary contact 202 under conditions wherein switch 120 is operated so as to interrupt an electric load.

Under normal operating conditions of controller 100, isolation switch 120 is not used to interrupt an electric load other than the control circuit. Contactor 150 is normally used to "interrupt" or to "make" electric circuit to a load. Isolation switch 120 is normally used to simply isolate all downstream electrical components from the voltage brought into controller 100 by bus conductors 110*a*, 110*b*, 110*c*. Normally isolation switch 120 only interrupts current to a control transformer taken through control transformer fuse links 139.

An interlock mechanism is provided to prevent operation of isolation switch 120 when the contacts of contactor 150 are closed, thereby preventing isolation switch 150 from interrupting or closing an electric current to a load.

Figure 13:
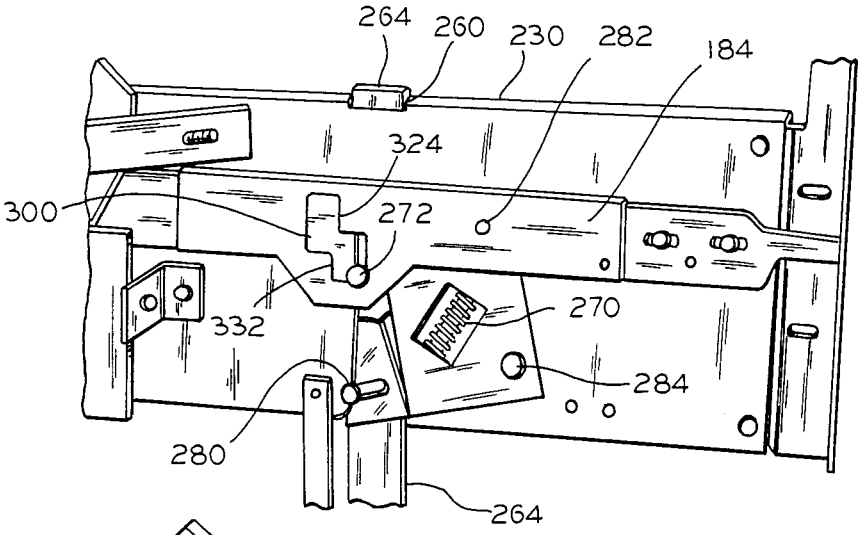
FIG. 13 is a perspective view of an isolation switch operating mechanism.
Figure 15:
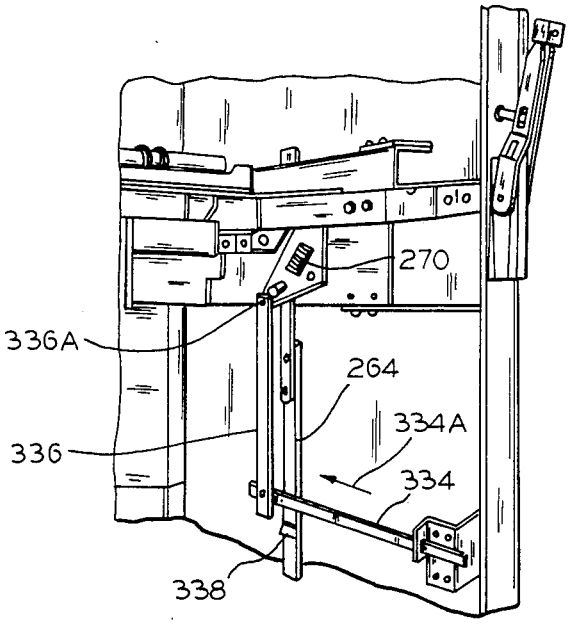
FIG. 15 is a perspective view of an isolation switch operating mechanism.
Figure 18:
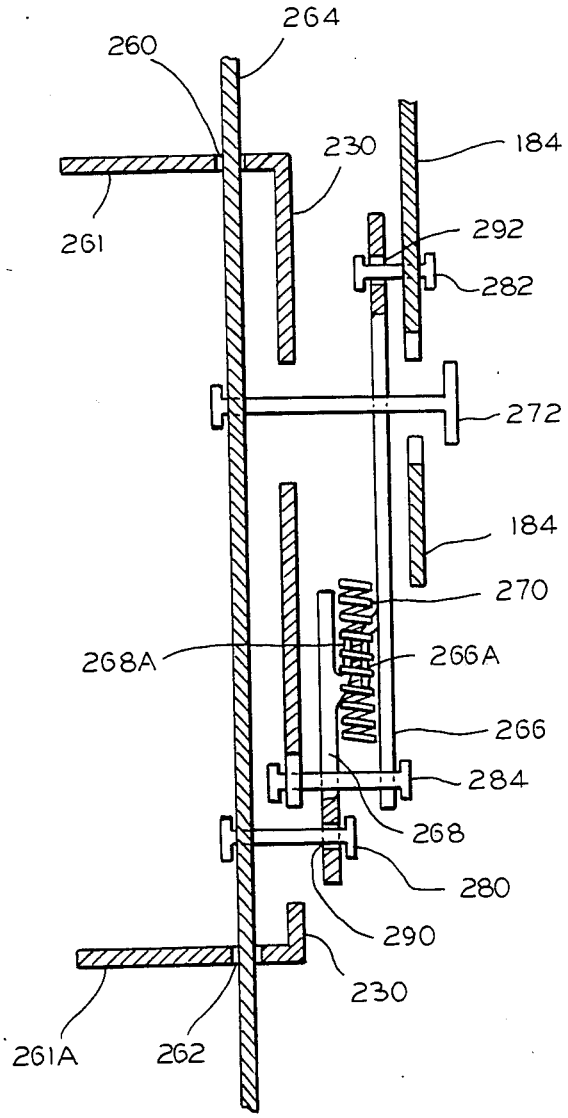
FIG. 18 is a sectional view taken along sectional arrow 18 as shown in FIG. 3 and shows details of an interlock mechanism.

Details of the interlock mechanism are shown in FIG. 3, FIG. 13, FIG. 15, FIG. 16, FIG. 17 and in FIG. 18. FIG. 18 is a section view taken through the section shown by arrows 18 in FIG. 3. Referring to FIGS. 13, 15, and 18, details of the interlock mechanism are shown. Plate 230 supports interlock link 264. Interlock link 264 passes through slots 260 and 262 formed in extensions 261 and 261*a* of plate 230. Interlock link 264 moves vertically in slots 260, 262. First crank 266 and second crank 268 are pivoted about pivot pin 284. Pivot pin 284 may be, for example, riveted into plate 230. Crank spring 270 connects first crank 266 and second crank 268 by slipping onto projections 266*a* and 268*a* of first crank 266 and second crank 268 respectively. Rotation in either direction of cranks 266 and 268 relative to each other about pivot pin 284 tends to compress crank spring 270. Vertical crank pin 280 is, for example, rivited into interlock link 264. Groove 290 in second crank 268 slides over vertical crank pin 280. Groove 292 in first crank 266 slides over horizontal crank pin 282. Thus, motion of link 184 in either the direction of arrow 185*a* or arrow 185*b* moves horizontal crank pin 282 either above the plane of FIG. 18 or below the plane of FIG. 18, thereby causing rotation of first crank 266 about pivot pin 284, and thereby compresses crank spring 270. Compression of crank spring 270 causes rotation of second crank 268 about pivot pin 284 and therefore causes the surface of groove 290 to bear against vertical crank pin 280 and urge vertical motion of interlock link 264. The maximum force that can be transmitted to interlock link 264 in the vertical direction by means of horizontal motion of link 184 is limited by the compressional force exerted by crank spring 270 between first crank 266 and second crank 268.

The limitation of vertical force that can be exerted on interlock link 264 is important in protecting contactor 150 from breakage should excessive force be applied to link 184 in urging it to move in either direction shown by arrow 185*a* or arrow 185*b*.

Figure 19:
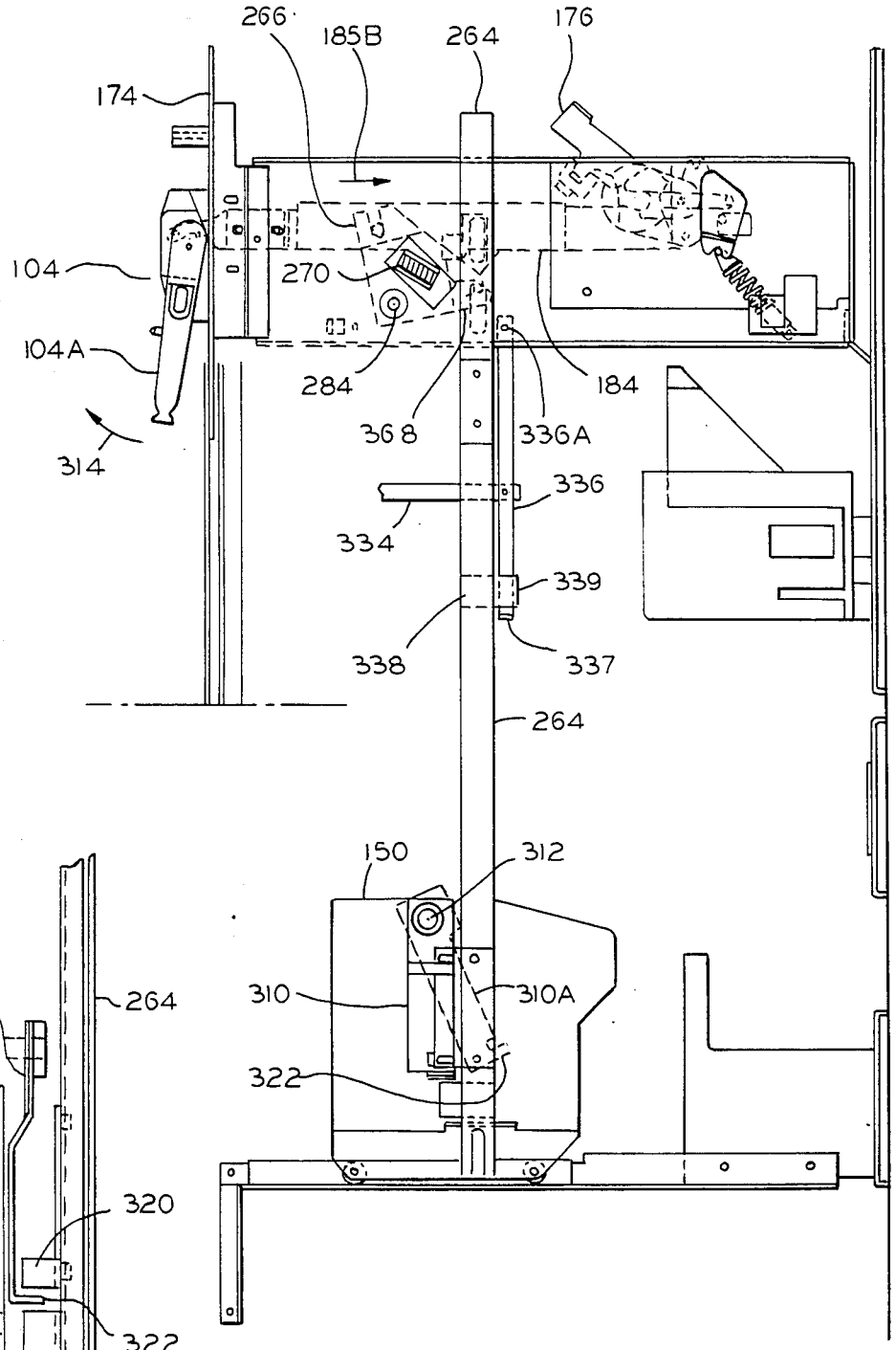
FIG. 19, FIG. 20, FIG. 21, FIG. 22, FIG. 23, and FIG. 24 are detailed views of an interlock mechanism.
Figure 20:
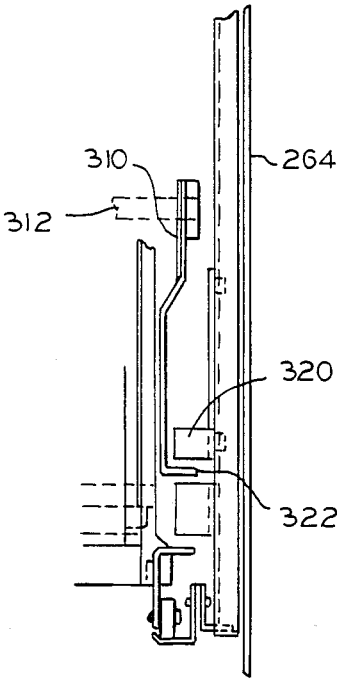

The cooperation of interference pin 272, which is rivited into interlock link 264, with the double rectangular opening 300 in link 184, as shown in detail in FIG. 13, provides a mechanism for preventing operation of isolation switch 120 when contactor 150 is in the closed position. FIG. 19 and FIG. 20 show cooperation of interlock link 264 and flag 310 of contactor 150.

Figure 21:
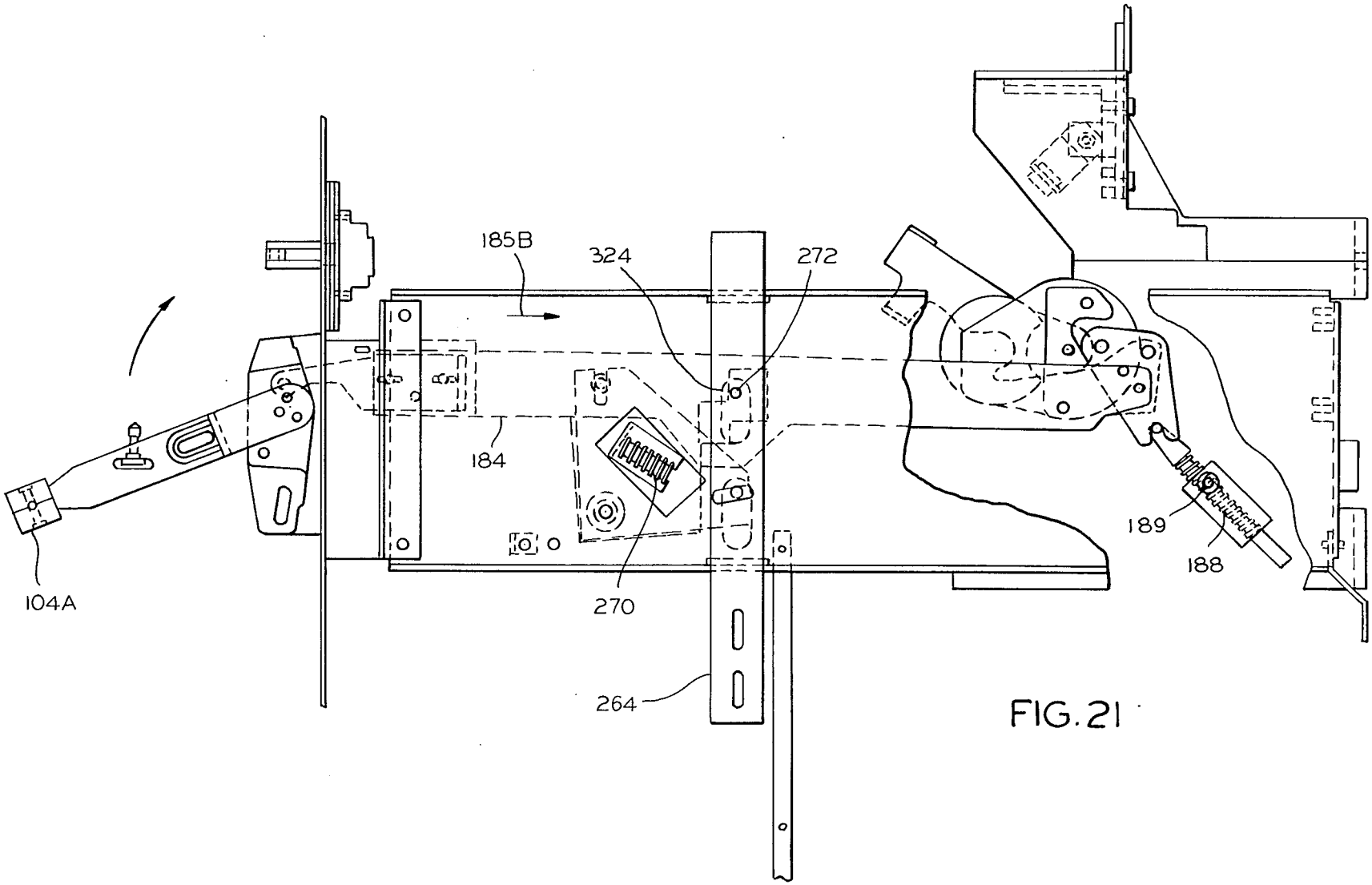

Flag 310 is rigidly attached to armature axle 312 of contactor 150. When contactor 150 is in the open position, flag 310 takes a position as shown by dotted line 310*a* in FIG. 19. When contactor 150 has its contacts in the closed position, flag 310 is in the position as shown by solid lines 310 in FIG. 19. FIG. 19 shows isolation switch 120 (not shown in FIG. 19) in the open position. Switch blade 176 is shown in FIG. 19 in the open position. An attempt to close isolation switch 176 by moving hand lever 104*a* of handle 104 in the direction shown by arrow 314 is prevented by cooperation between flag 310 and interlock link 264. Motion of hand lever 104*a* in the direction shown by arrow 314 urges link 184 to move in the direction shown by arrow 185*b*. Motion of link 184 in the direction shown by arrow 185*b* has two effects, the first is to cause closure of switchblades 176, and the second effect is to cause clockwise rotation of first crank 266 and second crank 268 about pivot pin 284. Motion of first crank 268 in the clockwise direction tends to move interlock link 264 downwardly. However, when flag 310 is in the position shown for a closed contactor then tab 320, attached rigidly to interlock link 264, catches against projection 322 of flag 310. The catching of tab 320 against projection 322 prevents interlock link 264 from moving downwardly. Referring to FIG. 21, interference pin 272 then catches against surface 324 of double rectangular opening 300. FIG. 21 shows interference pin 272 engaged against surface 324, thereby preventing further motion of link 184 in the direction shown by arrow 185*b*. Thus, the engagement of tab 320 against projection 322 of flag 310 prevents closure of isolation switch 120 by means of interference pin 272 engaging against surface 324, thereby directly preventing motion of link 184 in the direction shown by arrow 185*b*.

Figure 22:
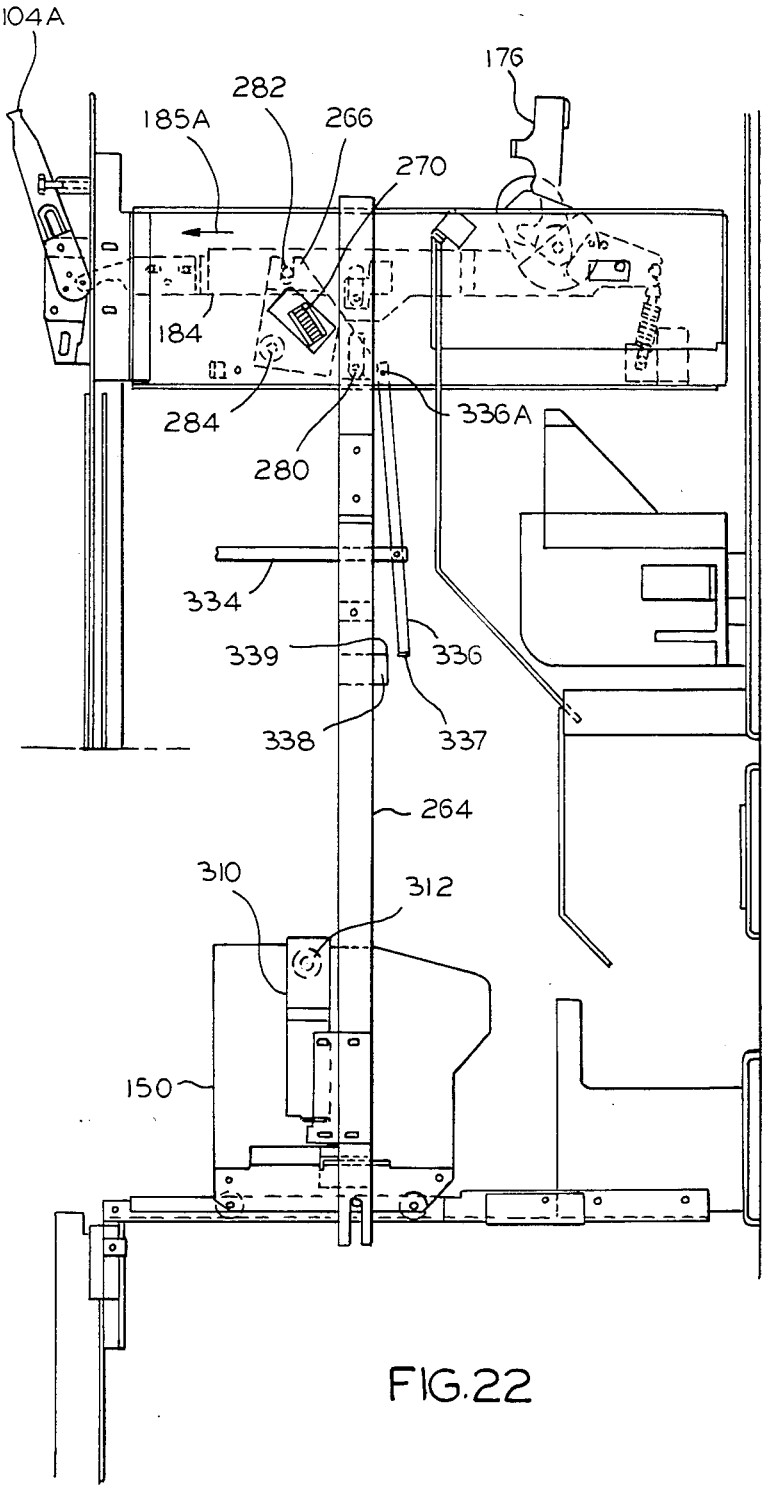
Figure 23:
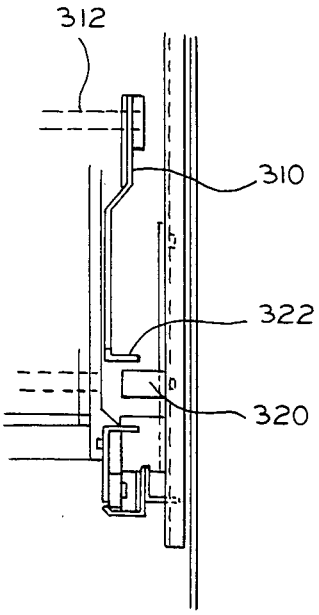
Figure 24:
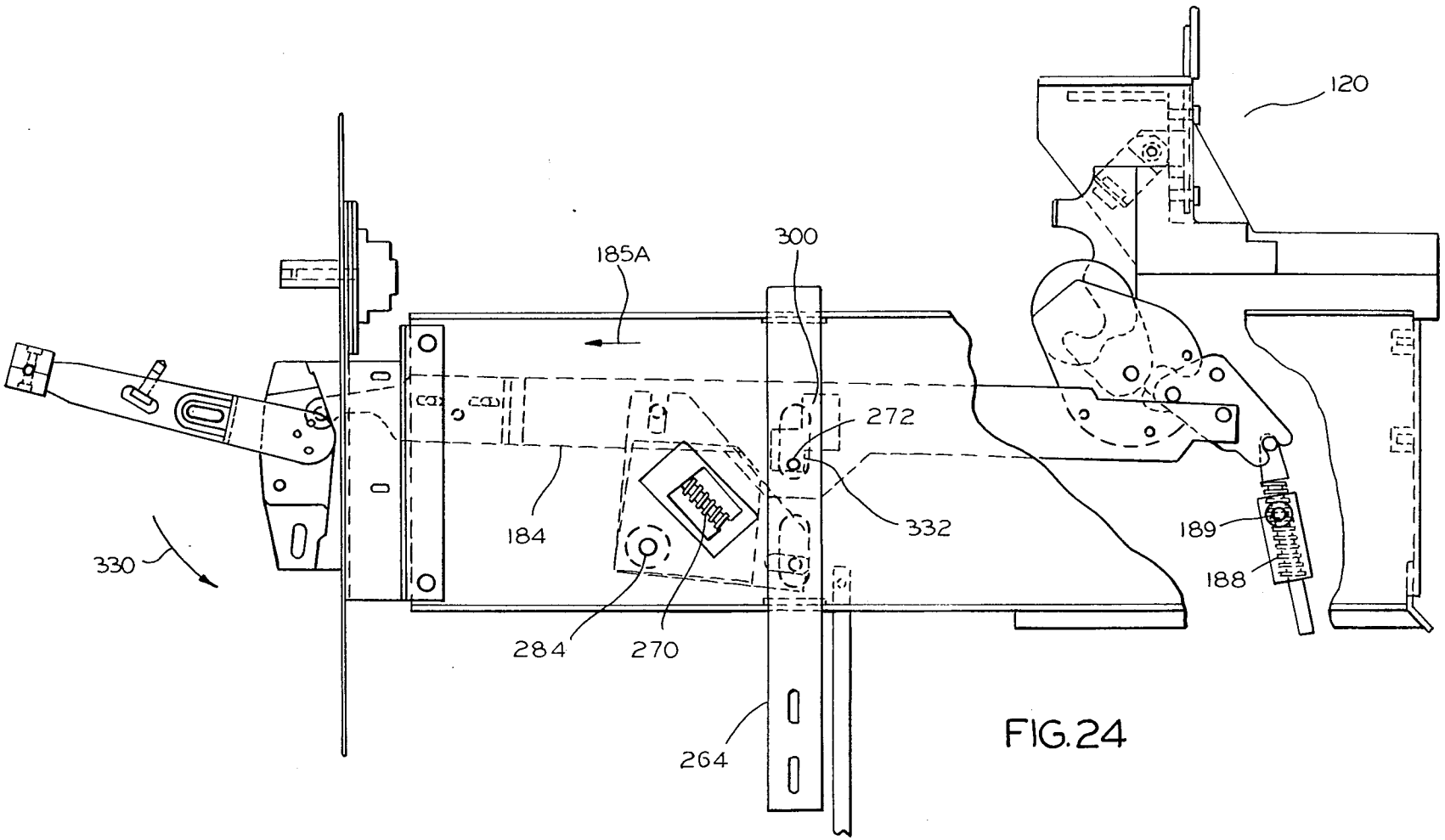

Operation of the interlock mechanism to prevent opening of isolation switch 120 when contactor 150 is closed is shown in FIG. 22, FIG. 23, and FIG. 24. When switch blades 176 are in the closed position, as shown in FIG. 22, interlock link 264 is moved downwardly so that tab 320 is beneath projection 322 of flag 310. An attempt to open isolation switch 120 by moving switchblades 176 into the open position is illustrated by arrow 330 showing motion of hand lever 104*a*. Motion of hand lever 104*a* in the direction shown by arrow 330 urges link 184 to move in the direction by arrow 185*a*. Motion of link 184 in the direction shown by arrow 185*a* causes rotation of first crank 266 and second crank 268 in the counterclockwise direction about pivot pin 284. Under counterclockwise urging, second crank 268 urges interlock link 264 to move in the vertical direction upwardly. Upward motion of interlock link 264 is prevented by tab 320 catching underneath projection 322 of flag 310. Prevention of interlock link 264 from moving vertically upward by tab 320 catching beneath projection 322 of flag 310 causes interference pin 272 to matingly engage surface 332 of double rectangular cutout 300. Engagement of surface 332 against interference pin 272 prevents further motion of link 184 in the direction shown by arrow 185*a*, thereby directly preventing opening of isolation switch 120.

The force limiting function of first crank 266, second crank 268, and crank spring 270 as they pivot about pivot pin 284 limits the force that can be exerted against contactor 150 through contactor flag 310. The maximum force that can be exerted against projection 322 by interlock link 264 is limited by the compression force exerted by crank spring 270. This force limiting feature of crank spring 270 is important to prevent excessive force being exerted against contactor 150 by excessive force exerted by an individual operator against hand lever 104*a*. It is not unusual for an operator to exert excessive force against a hand lever such as hand lever 104*a*. Without the intermediate spring mechanism such as crank spring 270 to limit the force transmitted to the contactor, it is possible for an operator to overforce hand lever 104*a* and break the structure of contactor 150.

Figure 25:
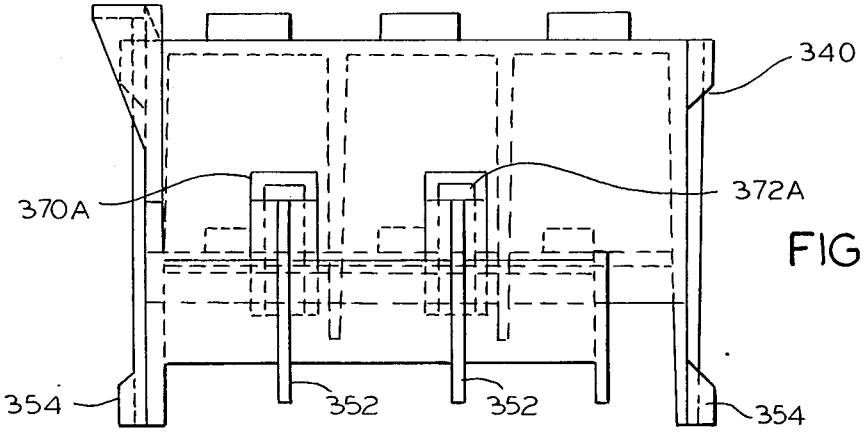

FIG. 25 is a top view of a molding 340 for an isolation switch.

Figure 27:
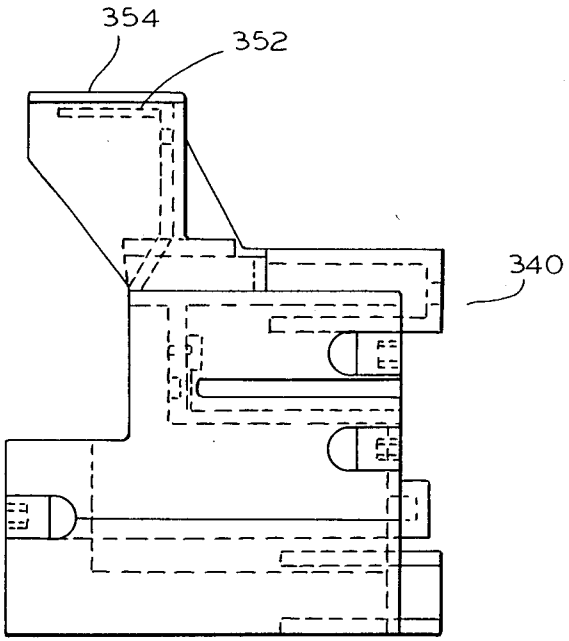
FIG. 25, FIG. 26 and FIG. 27 are top, front, and side views, respectively, of a molding for an isolation switch.
Figure 26:
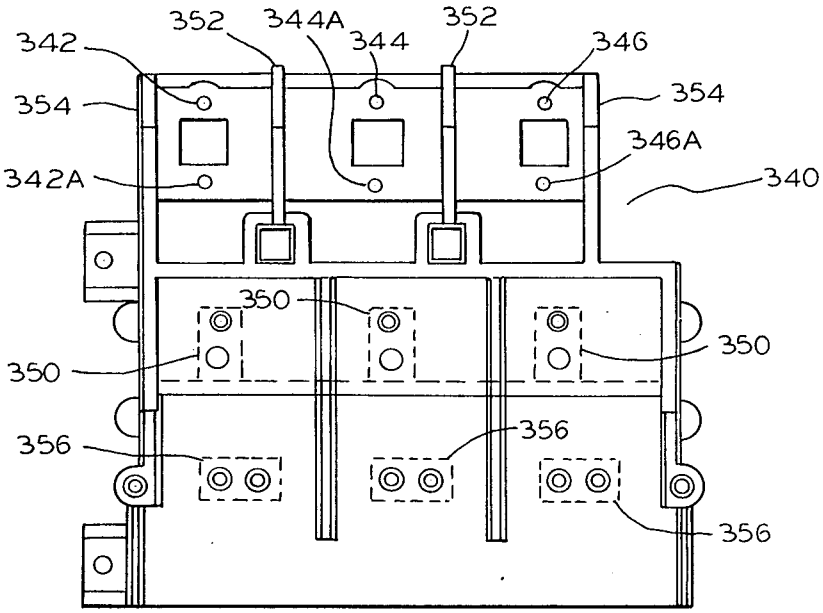

FIG. 26 is a front view of molding 340, and FIG. 27 is a side view of molding 340. For example, molding 340 may be made of glass reinforced polyester. Mounting holes 342, 342*a*, 344 344*a*, and 346, 346*a* provide a means for attaching stationary contacts 202 to the isolation switch molding 340. Mounting holes 350 provide a means for attaching pivot 244, as shown in FIG. 4, for switch blades 176. Barriers 352 and end plates 354 provide compartment isolation for the three phases of a three phase AC circuit. Mounting holes 356 provide a means for attaching upper fuse clips to isolation switch molding 340 for the line side of power fuses 132, as shown FIG. 2.

It is to be understood that the above-described embodiments are simply illustrative of the principles of the invention. Various other modifications and changes may be made by those skilled in the art which will embody the principles of the invention and fall within the spirit and scope thereof.

What is claimed is:

1. An isolation switch comprising:

at least one first cam attached to a blade of said isolation switch, said first cam arranged to rotate about a first axis;

at least one second cam arranged to rotate about a second axis;

means for said first and said second cams to engage so that rotation of said second cam in a first rotational sense urges rotation of said first cam so as to engage said blade with a fixed contact, thereby closing said isolation switch;

means for said first cam, when under the influence of electromagnetic forces resulting from current flow through said isolation switch and tending to open said isolation switch, to urge rotation of said second cam in said first rotational sense; and, means for preventing rotation of said second cam in said first rotational sense beyond a predetermined angular position, said predetermined angular position being chosen to permit said second cam to close said isolation switch, and prevention of rotation of said second cam locks said isolation switch closed, thereby preventing forces developed on said isolation switch under short circuit conditions from opening said isolation switch.

2. The apparatus as in claim 1 wherein said means for said first and said second cams to engage comprises:

a surface of said first cam in contact with said second cam so that said first cam may exert force on said second cam by contact between said surface and said second cam, where said forces urges counterclockwise rotation of said second cam and where clockwise rotation of said second cam urges said isolation switchblades to open.

3. The apparatus as in claim 1 wherein said at least one first cam attached to a blade of said isolation switch further comprises:

a rotatable member arranged to rotate about said first axis;

a first cam attached to a first end of said rotatable member and a second cam attached at a second end of said rotatable member;

said blade of said isolation switch is attached to said rotatable member so that rotation of said rotatable member in a first direction brings said blade into contact with said fixed contact thereby closing said isolation switch, and rotation of said rotatable member in a second rotational sense pulls said blade away from said fixed contact thereby opening said isolation switch.

4. The apparatus as in claim 1 wherein said at least one second cam arranged to rotate about a second axis comprises:

an axle mounted with said axis substantially coincident with a center line of said axle;

a first second cam mounted on a first end of said axle, a second second cam mounted on a second end of said axle, said first second cam arranged to engage one of said first cam, and said second second cam arranged to engage another of second of said first cam.

5. The apparatus as in claim 1 wherein said means for said first and said second cams to engage comprises:

said at least one first cam is made of sheet metal, and has an opening cut therein; and, said at least one second cam is made of sheet metal and has a drive pin attached thereto, said drive pin engaging a surface of said opening in said at least one first cam, so that pressure by said drive pin on said surface of said opening, urges said first cam to rotate about said first axis.

6. The apparatus as in claim 1 wherein said means for said first cam, under the influence of electromagnetic forces resulting from current flow through said isolation switch tending to open said isolation switch, to urge rotation of said second cam in said first rotational sense, comprises:

a surface formed in said at least one first cam;

a drive pin attached to said at least one second cam and arranged to engage with said surface of said first cam;

a rest position for said second cam after urging said isolation switch into a closed position, said rest position locating said surfaced formed on said first cam, said drive pin, and said second axis to urge said rotation of said second cam in said first rotational sense.

7. The apparatus as in claim 1 wherein said means for preventing rotation of said second cam in said first rotational sense beyond the predetermined angular position, comprises:

a frame for mounting said isolation switch, said frame being made of sheet metal and having an opening cut therein; and, a stop pin attached to said second cam and protruding through said opening in said frame, said opening being sufficiently large to permit rotation of said second cam in opening and closing said isolation switch, and said stop pin resting against an inner surface of said opening in said predetermined angular position when said isolation switch is closed, said stop pin exerting force against said frame to maintain said second cam in said predetermined angular position, thereby locking said isolation switch in said closed position and preventing forces applied to said blade in a direction to open said isolation switch from opening said isolation switch.

8. The apparatus as in claim 6 wherein said rest position of said second cam is said predetermined angular position.

9. An isolation switch comprising:

at least one moveable blade;

a bail arm arranged to rotate about a first axis, and having said at least one moveable blade attached thereto so that said at least one moveable blade rotates with said bail arm;

at least one first cam attached to said bail arm;

at least one second cam arranged to rotate about a second axis;

means for said at least one first and said at least one second cams to engage so that rotation of said second cam in a first rotational sense urges rotation of said bail arm in a direction to close said isolation switch, and so that rotation of said second cam in a second rotational sense urges rotation of said bail arm in a direction to open said isolation switch;

means for said first cam to urge rotation of said second cam in said first rotational sense under the influence of forces applied to said moveable blade and tending to open said isolation switch; and, means for preventing said second cam to rotate in said first rotational sense beyond a predetermined angular position, said predetermined angular position being chosen to permit closing of said isolation switch by rotation of said first cam in said first rotational sense, so that rotation of said bail arm, by forces acting on said at least one moveable blade, is prevented by said "means for preventing said second cam to rotate in said first rotational sense beyond a predetermined angular position".

10. The apparatus as in claim 9 wherein said means for said at least one first and said at least one second cams to engage, comprises:

said at least one first cam is made of sheet metal, and has an opening cut therein; and, said at least one second cam is made of sheet metal and has a drive pin attached thereto, said drive pin engaging a surface of said opening in said at least one first cam, so that pressure by said drive pin on said surface of said opening, under the influence of rotation of said second cam in said first rotational sense, urges rotation of said first cam so as to move said movable blade into a "closed" position of said isolation switch. and forces generated by said drive pin, under the influence of rotation of said second cam in said second rotational sense, urges rotation of said first cam so as to move said moveable blade into an "open" position of said isolation switch.

11. The apparatus as in claim 9 wherein said means for said bail arm and said first cam to urge rotation of said second cam in said first rotational sense under the influences of forces applied to said moveable blade, comprises:

means for said first cam to apply force to a drive pin attached to said second cam; and, means for said forces applied by said first cam to said drive pin to urge rotation of said second cam in said first rotational sense.

12. The apparatus as in claim 11 wherein said means for said forces applied by said first cam to said drive pin to urge rotation of said second cam in said first rotational sense, comprises:

a rest position for said second cam after urging said isolation switch into a closed position, said rest position locating said drive pin and said second axis to urge said rotation of said second cam in said first rotational sense.

13. The apparatus as in claim 9 wherein said means for preventing said second cam to rotate in said first rotational sense beyond a predetermined angular position, comprises:

a frame for mounting said isolation switch, said frame being made of sheet metal and having an opening cut therein; and, a stop pin attached to said second cam and protruding through said opening in said frame, said opening being sufficiently large to permit rotation of said second cam in opening and closing said isolation switch, and said stop pin resting against an inner surface of said opening in said predetermined angular position when said isolation switch is closed, said stop pin exerting force against said frame to maintain said second cam in said predetermined angular position, thereby locking said isolation switch in said closed position and preventing forces applied to said blade in a direction to open said isolation switch from opening said isolation switch.

14. The apparatus as in claim 9 wherein said forces applied to said moveable blade and tending to open said isolation switch are electromagnetic forces generated by electric current flow through said isolation switch.

15. The apparatus as in claim 9 wherein said rotation of said second cam in said first rotational sense is rotation in a counterclockwise direction about said second axis.

16. The apparatus as in claim 9 wherein said rotation of said second cam in said second rotational sense is rotation in a clockwise direction about said second axis.

17. An isolation switch comprising:

at least one moveable blade;

a bail arm arranged to rotate about a first axis and having said at least one moveable blade attached thereto so that said at least one moveable blade rotates with said bail arm;

at least one first cam attached to said bail arm;

at least one second cam arranged to rotate about a second axis;

said at least one second cam being made of sheet metal and having a drive pin attached thereto, said at least one first cam being made of sheet metal, and having an opening cut therein, said drive pin engaging a surface of said opening in said at least one first cam, so that pressure by said drive pin on said surface of said opening, under the influence of rotation of said second cam in a first rotational sense, urges rotation of said first cam so as to move said moveable blade into a "closed" position of said isolation switch, and forces generated by said drive pin, under the influence of rotation of said second cam in said second rotational sense, urges rotation of said first cam so as to move said moveable blade into an "open" position of said isolation switch;

a predetermined angular position for said second cam after urging said isolation switch into a closed position, said predetermined angular position locating said drive pin and said second axis to urge rotation of said second cam in said first rotational sense under the influence of force applied to said at least one moveable blade tending to open said isolation switch by rotating said bail arm;

a frame for mounting said isolation switch, said frame being made of sheet metal and having an opening cut therein; and, a stop pin attached to said at least one second cam and protruding through said opening in said frame, said opening being sufficiently large to permit rotation of said at least one second cam in opening and closing said isolation switch, and said stop pin resting against an inner surface of said opening in said predetermined angular position when said isolation switch is closed, said stop pin exerting force against said frame to maintain said at least one second cam in said predetermined angular position, thereby locking said isolation switch in said closed position and preventing forces applied to said blade, in a direction to open said isolation switch, from opening said isolation switch.

18. An isolation switch comprising:

at least one moveable blade (176);

a bail arm (124) arranged to rotate about a first axis and having said at least one moveable blade (176) attached thereto so that said at least one moveable blade (176) rotates with said bail arm (124);

at least one first cam (182, 182A) attached to said bail arm;

at least one second cam (187, 187A) arranged to rotate about a second axis;

said at least one second cam (187, 187A) being made of a metal plate and having a drive pin (198, 198A) attached thereto, said at least one first cam being made of a metal plate, and having an opening cut therein, said drive pin (198, 198A) engaging a surface (199, 222) of said opening in said at least one first cam (182, 182A), so that pressure by said drive pin (198, 198A) on said surface (199, 222) of said opening, under the influence of rotation of said second cam (187, 187A) in a first rotational sense, urges rotation of said first cam (182, 182A) so as to move said moveable blade (176) into a "closed" position of said isolation switch, and forces generated by said drive pin (198, 198A), under the influence of rotation of said second cam (187, 187A) in said second rotational sense, urges rotation of said first cam (182, 182A) so as to move said moveable blade (176) into an "open" position of said isolation switch;

a predetermined angular position for said second cam after urging said isolation switch into a closed position, said predetermined angular position locating said drive pin (198, 198A) and said second axis to urge rotation of said second cam (187, 187A) in said first rotational sense, by said surface (222), under the influence of force applied to said at least one moveable blade (176) tending to open said isolation switch by rotating said bail arm (124);

a frame (230) for mounting said isolation switch, said frame (230) being made of a metal plate and having an opening (232) cut therein; and, a stop pin (196, 196A) attached to said at least one second cam (187, 187A) and protruding through said opening (232) in said frame, said opening being sufficiently large to permit rotation of said at least one second cam (187, 187A) in opening and closing said isolation switch, and said stop pin (196, 196A) resting against an inner surface of said opening in said predetermined angular position (197) when said isolation switch is closed, said stop pin (196, 196A) exerting force against said frame in the direction of arrow (234) to maintain said at least one second cam (187, 187A) in said predetermined angular position, thereby locking said isolation switch in said closed position and preventing forces applied to said blade (176), in a direction to open said isolation switch, from opening said isolation switch.

* * * * *